US005231863A

United States Patent [19]

Joyner et al.

[11] Patent Number: 5,231,863

[45] Date of Patent: Aug. 3, 1993

[54] MANDREL LOADING METHOD AND APPARATUS IN A THERMAL SIZING-ANNEALING PROCESS

[75] Inventors: David W. Joyner, Wilmington; James C. Risley, Carolina Beach; Grover T. Henry, Burgaw, all of N.C.

[73] Assignee: General Electric Company, San Jose, Calif.

[21] Appl. No.: 873,141

[22] Filed: Apr. 24, 1992

[51] Int. Cl.[5] ..... B21D 39/20

[52] U.S. Cl. ..... 72/342.1; 72/370; 72/353.4; 72/710

[58] Field of Search ..... 72/370, 353.4, 710, 72/342.1

[56] References Cited

U.S. PATENT DOCUMENTS

| | | | |
|---|---|---|---|
| 3,354,680 | 11/1967 | Jacobsen | 72/370 |
| 3,640,116 | 2/1972 | Hellman | 72/370 |
| 3,759,203 | 9/1973 | Frankenberg | 72/370 |
| 4,337,634 | 7/1982 | Strudel | 72/370 |
| 4,989,433 | 2/1991 | Harmon et al. | 72/38 |
| 5,027,635 | 7/1991 | Wilks | 72/342.7 |
| 5,095,733 | 3/1992 | Poruczak et al. | 72/710 |

FOREIGN PATENT DOCUMENTS

| | | | |
|---|---|---|---|
| 1450279 | 8/1966 | France | 72/370 |
| 0215418 | 8/1989 | Japan | 72/353.4 |

*Primary Examiner*—Lowell A. Larson
*Assistant Examiner*—Michael J. McKeon
*Attorney, Agent, or Firm*—J. S. Beulick

[57] ABSTRACT

To facilitate safe loading of a thermal sizing mandrel in an elongated channel of open rectangular cross section, a corner rod die is first lowered into a fixture, and then a channel is lowered into the fixture to a vertical position surrounding the die. A mandrel is inserted downwardly through the channel open interior to press corner rods of the die outwardly against the channel corners to elastically reform the channel substantially to a specified geometry. Mandrel insertion is facilitated by inducing vibratory energy therein and by forming shoes in the fixture acting against the channel outer sides to square off the mandrel cross section in advance of mandrel insertion.

17 Claims, 2 Drawing Sheets

MANDREL LOADING METHOD AND APPARATUS IN A THERMAL SIZING-ANNEALING PROCESS

The present invention relates to metal forming and particularly to correcting geometric and dimensional irregularities in elongated, tubular members.

BACKGROUND OF THE INVENTION

There are numerous components of industrial and utility equipment whose dimensional and geometric characteristics are of a critical nature and therefore must be manufactured to extremely strict specifications. A notable example of one such critical component is the flow channel of a nuclear fuel assembly or bundle, such as disclosed in U.S. Pat. No. 3,689,358. These channels are elongated tubular components of square cross section, which may measure approximately 6 inches on each side and on the order of 14 feet in length. Typically, the channels are created by seam welding two U-shaped channel sections together. The preferred material is a zirconium alloy, such as Zircaloy, on the order of 125 mils thick. It is imperative that these flow channels are manufactured to the proper dimensions and be free of geometric irregularities, such as face or side bulge, out-of-square cross sections, non-parallelism of sides, longitudinal bow and twist, and the like. Unfortunately, the channel creating step leaves residual geometric and dimensional irregularities, as well as residual stresses. Thus as a final manufacturing step, the channels must undergo a thermal sizing and annealing step to eliminate these irregularities and stress.

The thermal sizing-annealing step involves inserting an elongated, closed-fitting mandrel into the channel and raising the temperature of the channel to about 1100° F. in an inert atmosphere. By virtue of the differential thermal expansion of the channel and mandrel, the mandrel expands into engagement with the channel, causing the channel to yield plastically to the specified final form. Typically, the outwardly directed mandrel forces are exerted solely on the four corners of the channel throughout their lengths. After a suitable anneal time, the channel is returned to room temperature and the mandrel is withdrawn, leaving the channel in a stable form substantially free of geometric irregularities and stress. It has been found that mandrel insertion is sometimes quite difficult due to the fact that certain irregularities produce sliding friction between the channel and the mandrel as the latter progresses into the channel interior. A particularly serious problem, however, is scoring of the interior corner surfaces inflicted during mandrel insertion, mandrel withdrawal, and/or relative movements of the mandrel and channel surfaces during the heat-up/cool down cycle due to differential thermal expansion. Such surface blemishes must be removed by abrasive techniques, resulting in wall thinning in the mechanically critical corners of the channel. If not removed, the blemishes may cause stress concentration sites during operation in a nuclear reactor core. They must therefore be avoided.

The thermal sizing apparatus of commonly assigned Wilks U.S. Pat. No. 5,027,635 is specifically directed to facilitating insertion and withdrawal of a mandrel into and from the interior of a channel involved in a thermal sizing-annealing process, while avoiding channel surface damage. The apparatus of this patent includes a die having four elongated die elements, which is initially inserted into a channel with the die elements respectively situated in coextensive, contiguous relation with the four corners of the channel. A mandrel equipped with a plurality of rollers is then inserted into the channel. The rollers are situated to make rolling contact with the die elements, thereby facilitating insertion as the die elements are pressed into the channel corners. Since the mandrel engages the stationary die elements rather than the mandrel during insertion and withdrawal, scoring of the channel inner corner surfaces is eliminated. When the mandrel and channel are heated to a suitable channel thermal sizing-annealing temperature, the mandrel expands at a faster rate than the roller journal mountings to the mandrel, such that mandrel bearing surfaces grow outwardly beyond the roller peripheries into thermal sizing engagement with the die elements. While the apparatus of this patent, in theory, achieves the desired objectives, it has several practical drawbacks. The mandrel design is relatively complex and extremely expensive to fabricate. Also, with repeated thermal cycling, the roller journals either develop excessive play or bind up. All too frequent adjustment and maintenance is thus required to maintain facile mandrel insertion and to avoid irreparable damage to the roller journals. If the channel is badly deformed, e.g., excessive bow or twist, mandrel insertion is difficult, even with the rollers.

SUMMARY OF THE INVENTION

In accordance with the present invention, there is provided mandrel loading apparatus and method which are convenient and inexpensive in implementation to facilitate insertion of a mandrel into an elongated tubular member incident to a thermal sizing and annealing process. Moreover, mandrel insertion is achieved without damage to the interior surface of the member.

To achieve these objectives, the apparatus includes a vertically oriented fixture into which is positioned a die comprising a plurality of elongated die elements held in assembly by upper and lower tie plates. A tubular member, in the form of a channel of rectangular cross section, is then inserted over the die with the die elements of circular cross section assuming positions proximate the inner corners of the members. An elongated thermal sizing mandrel is then inserted into the channel. The mandrel is of generally rectangular cross section having a pair of full length, orthogonally arranged planar bearing surfaces at each corner. Each bearing surface pair engages a different one of the die elements during mandrel insertion which is facilitated by inducing vibratory energy in the mandrel. To further promote facile mandrel insertion, the fixture is equipped at each of its four sides with a vertical series of forming shoes which, as needed, are pressed against the outer channel sides to square off the channel cross section in advance of the penetrating mandrel. When the mandrel is fully inserted, the channel is ready to be thermally sized and annealed.

BRIEF DESCRIPTION OF THE DRAWINGS

For a full understanding of the nature and objects of the present invention, reference may be had to the following Detailed Description, taken in conjunction with the accompanying drawings, in which.

Corresponding reference numerals refer to like parts throughout the several views of the drawings.

DETAILED DESCRIPTION

Figure 1:
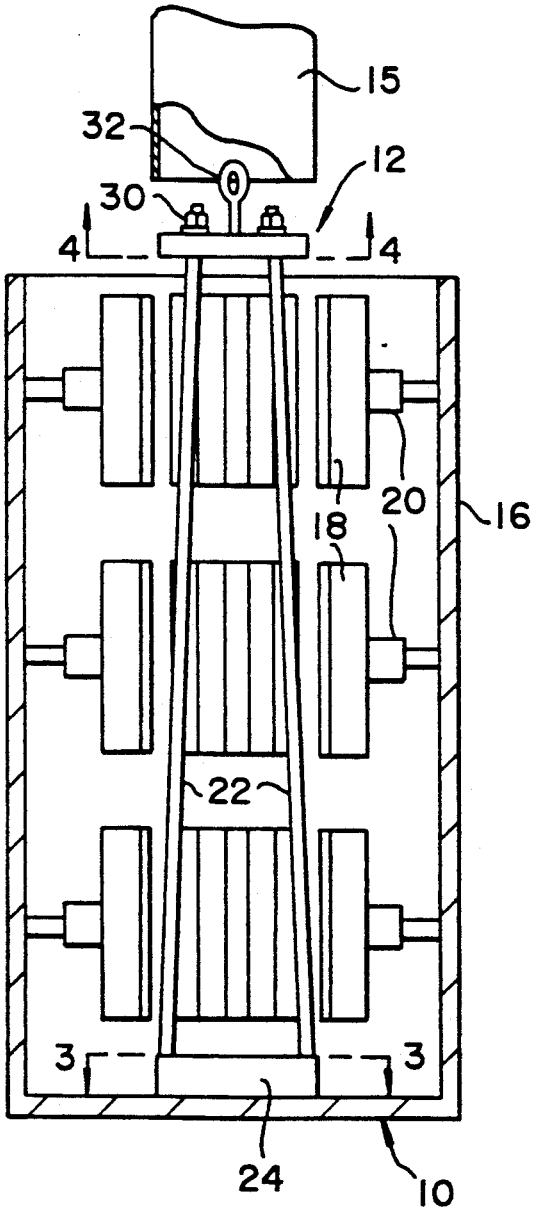
FIG. 1 is an elevational view, partially in section, of the mandrel loading apparatus of the present invention illustrating a corner rod die positioned in a fixture and an elongated channel poised for insertion over the die.
Figure 2:
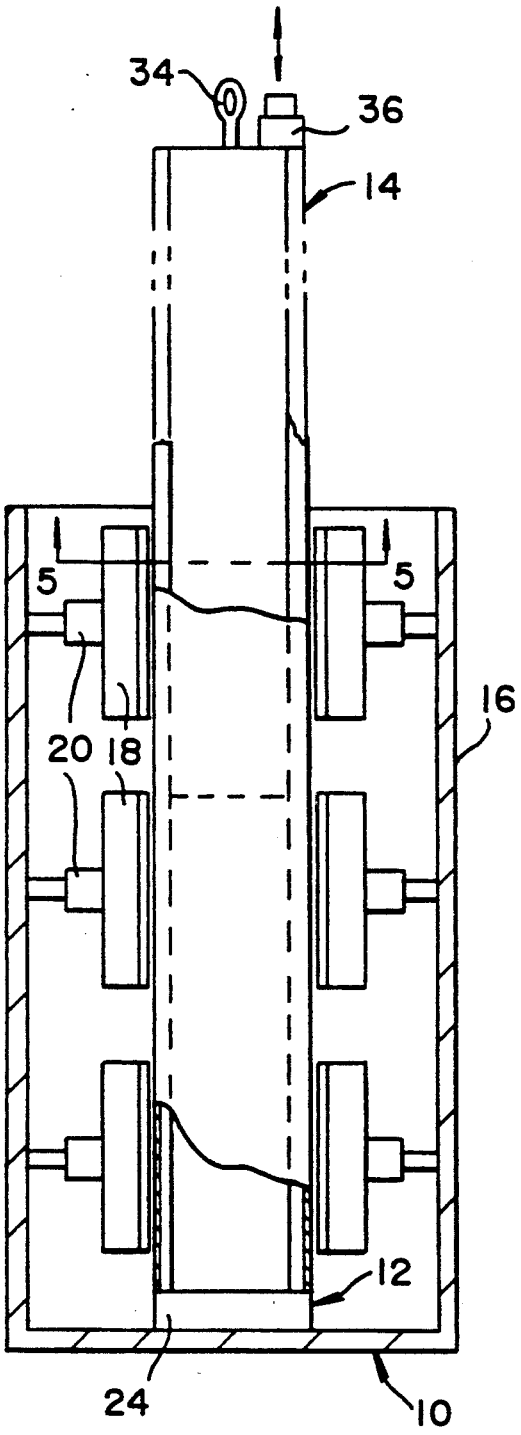
FIG. 2 is an elevational view, partially in section and partially broken away, of the apparatus of FIG. 1 illustrating partially insertion of a thermal sizing mandrel.
Figure 5:
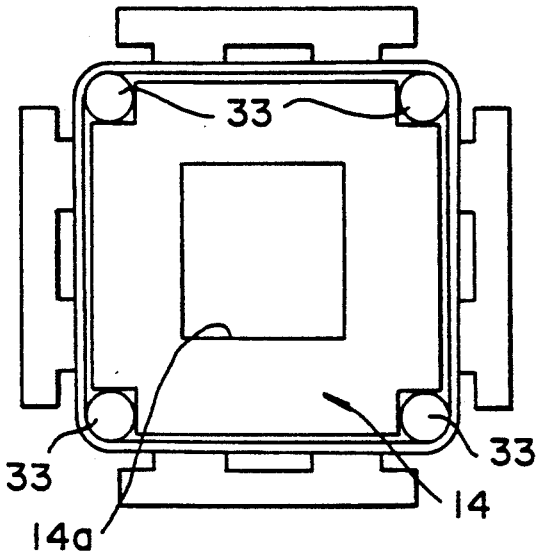
FIG. 5 is a sectional view taken along line 5—5 of FIG. 2.

The mandrel loading apparatus of the present invention includes, as seen in FIGS. 1 and 2, a fixture, generally indicated at 10, a die, generally at 12, and a stainless steel, thermal sizing mandrel, generally indicated at 14 in FIGS. 2 and 5. The apparatus is utilized incident to a thermal sizing and annealing process for an elongated tubular channel 15, which in the illustrated embodiment is a rectangular flow channel utilized in nuclear fuel assemblies. Suitable thermal sizing-annealing method and apparatus are disclosed in commonly assigned Harmon et al. U.S. Pat. No. 4,989,433, whose disclosure is specifically incorporated herein by reference.

Fixture 10 includes a vertically oriented, generally rectangular form 16 serving to mount on each of its four internal sides a series of vertically spaced forming shoes 18 at corresponding elevational positions along the chamber vertical height. Each forming shoe is reciprocated horizontally by a separate linear actuator 20, such as a pneumatic or hydraulic cylinder.

Figure 3:
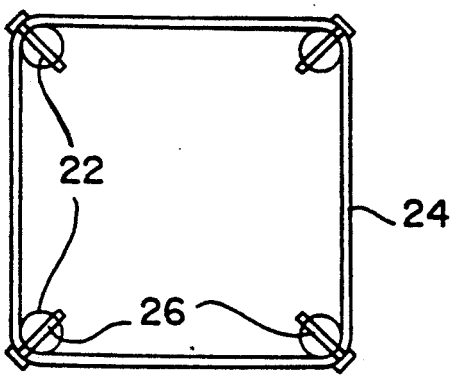
FIG. 3 is a sectional view taken along line 3—3 of FIG. 1.

Die 12 includes four elongated die elements 22, one for each corner of channel 15. As best seen in FIG. 3, the lower ends of these die elements are captured by a lower tie plate in the form of a rectangular band 24 to which a die element is somewhat loosely attached to each inside corner by a pin 26. Band 24 is of roughly the same cross section as channel 15.

Figure 4:
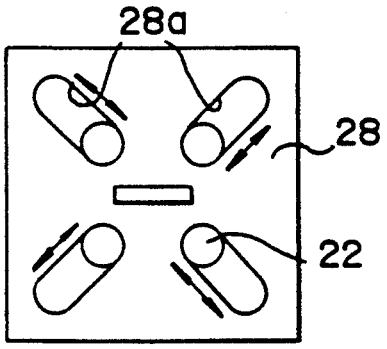
FIG. 4 is a sectional view taken along line 4—4 of FIG. 1.

As seen in FIGS. 1 and 4, the upper ends of die elements 22 project through diagonally elongated slots 28*a* in an upper tie plate 28. The upper terminations of the die elements are shouldered and threaded to accept bolts 30 clamping the die elements to the tie plate in upwardly converging relation as seen in FIG. 1. Thus the spacings between the upper ends of the die elements are less that the spacings between their lower ends established by band 24. The external dimensions of tie plate 28 are less than the internal dimensions of channel 15.

A hoist (not shown), utilizing upper tie plate hook 32, lowers die 12 into the fixture to a vertical position resting on the floor of form 16 and between the opposed series of forming shoes 20 in their retracted or outermost positions. The hoist then inserts channel 15 into fixture 10 and over die 12. By virtue of the upward convergence of the die elements, the channel passes freely over the upper tie plate and down over the die elements with only incidental, minimal contact therewith as the lower channel edge comes to rest on the upper edge of lower tie plate band 24. The linear actuators 20 may then be actuated in unison to extend forming shoes 20 into engagement with all channel four sides to center the channel in fixture 10.

To prepare the channel for mandrel insertion, upper tie plate 28 is removed, and die elements are manually positioned against the channel corners. The upper ends of the die elements may temporarily be tied off to form 16 to hold their channel corner positions for initial mandrel insertion. As best seen in FIG. 5, mandrel 14 is rectangular in cross section with external side dimensions on the order of twenty mils less than the internal side dimensions of the channel. The corners of the mandrel are notched to provide pairs of orthogonal, planar bearing surfaces 33 extending the full mandrel length. An internal passage 14*a* through the mandrel accommodates the flow of a high temperature inert gas, such as argon. The hoist raises the mandrel via a lifting hook 34 into vertical orientation over fixture 10, and the mandrel is angularly oriented manually to vertically align the mandrel corner notches with die elements 22. The mandrel is then lowered to bring the lower, leading ends of the pairs of bearing surfaces into engagement with the upper ends of the die elements extending above channel 15, as seen in FIG. 2. The ties holding the die elements in position are removed, and mandrel insertion proceeds as the hoist lowers the mandrel.

As insertion progresses, the mandrel bearing surfaces 33 press the die elements into the four interior corners of the channel to elastically reform the channel approximately to the requisite geometry. Since the die elements are of a cylindrical shape (circular cross section) essentially vertical line contacts are made between the die elements and their engaging mandrel bearing surfaces. Frictional forces impeding mandrel insertion are thus reduced. Preferably, during insertion deionized water is sprayed on the bearing surfaces as a lubrication to further reduce friction. The leading edges of the planar surfaces may be bevelled to avoid scoring the die elements. Since the die elements are cylindrical, standard stainless steel rod stock may be utilized. Thus machining the rods to a non-circular cross section is avoided.

As an additional mandrel insertion facilitator, a vibrator 36 is affixed to the top, trailing end of the mandrel, as seen in FIG. 2. Activation of this vibrator induces vibratory energy in the mandrel to promote insertion. On occasion, a channel's geometry may be sufficiently distorted that the mandrel binds up, halting insertion. In such case, the horizontal set of forming shoes 18 most proximate the leading end of the mandrel are simultaneously pressed against all four sides of the confronting channel section by their linear actuators 20 to remove localized geometric irregularities and thus allow insertion to proceed.

In addition to facilitating mandrel loading, the method and apparatus of the present invention avoids damaging the interior surface of the channel during mandrel insertion. This is due to the fact that the mandrel solely engages die elements 22 which, in turn, engage the channel corners. Since these die elements are essentially stationary during mandrel insertion, there is no sliding engagement with the mandrel to inflict surface damage thereto.

It is seen from the foregoing that the objectives of the present invention, included those made apparent from the Detailed Description, are efficiently attained, and, since certain changes may be made in the construction and method set forth without departing from the invention, it is intended that matters of detail be taken as illustrative and not in a limiting sense.

Having described the invention, what is claimed as new and desired to secure by Letters Patent is:

1. Apparatus for use in thermal sizing elongated channels having a plurality of essentially flat sides joined at corners to define an open interior, said apparatus comprising, in combination:

a) a elongated, vertically oriented fixture;

b) a die including a plurality of elongated cylindrical die elements held in assembly by upper and lower tie plates, said die positioned in said fixture with one of said die elements vertically disposed in contiguous, coextensive relation with the inner side of each channel corner upon positioning a channel in said fixture about said die; and c) an elongated mandrel for downward insertion through the channel interior, said mandrel having a separate pair of substantially coextensive, angularly related bearing surfaces arranged to slidingly engage said die elements during mandrel insertion, whereby said die elements are progressively pressed outwardly against said channel corners during mandrel insertion through the channel interior to elastically reform the channel substantially to a specified geometric shape in preparation for thermal sizing.

2. The apparatus defined in claim 1, wherein each said mandrel bearing surface is planar so as to make continuous line contact with one of said die elements.

3. The apparatus defined in claim 2, wherein said bearing surfaces of each said pair are orthogonally related.

4. The apparatus defined in claim 2, which further includes means for inducing vibratory energy in said mandrel to promote insertion.

5. The apparatus defined in claim 2, wherein said fixture includes means for exerting opposing, inwardly directed forces against the channel outer sides to remove mandrel insertion inhibiting geometric irregularities from the channel.

6. The apparatus defined in claim 5, wherein said force exerting fixture means includes a separate series of forming shoes distributed along the height of said fixture, each said forming shoe series positioned in confronting relation with a different channel side, and linear actuators for forcibly pressing selected said forming shoes into reforming engagement with the channel sides.

7. The apparatus defined in claim 5, wherein said upper tie plate holds said die elements in upwardly convergent relation to minimize contact with said die elements as the channel is lowered into position surrounding said die.

8. The apparatus defined in claim 7, which further includes means for inducing vibratory energy in said mandrel to promote insertion.

9. The apparatus defined in claim 8, wherein each said bearing surfaces of each said pair are orthogonally related.

10. A method for loading a mandrel into an elongated tubular channel having a plurality of substantially flat sides joined at corners to define an open interior, said method comprising the steps of:

a) providing a fixture;

b) lowering a die into the fixture, the die having a plurality of elongated, substantially vertically oriented die elements;

c) lowering a channel into the fixture to a position surrounding the die;

d) positioning the die elements into juxtaposed, coextensive positions against the channel corners; and e) inserting a mandrel downwardly through the open interior of the channel, the mandrel slidingly engaging only the die elements to press the die elements outwardly into the channel corners during mandrel insertion to elastically reform the channel substantially to a specified geometric shape in preparation for thermal sizing.

11. The method defined in claim 10, which further includes the step of inducing vibrator energy in the mandrel to facilitate said mandrel insertion step.

12. The method defined in claim 11, which further includes the step of spraying a lubricant onto bearing surfaces of the mandrel that slidingly engage the die elements.

13. The method defined in claim 10, which further includes the step of pressing forming elements against the outer sides of the channel to reform the channel substantially to the specified geometric shape in advance of mandrel insertion.

14. The method defined in claim 10, which further includes the step of configuring the die elements and bearing surfaces of the mandrel such that the bearing surfaces are in continuous line contact with the die elements during mandrel insertion.

15. The method defined in claim 14, which further includes the step of inducing vibratory energy in the mandrel to facilitate said mandrel inserting step.

16. The method defined in claim 15, which further includes the step of pressing forming elements against the outer sides of the channel to reform the channel substantially to the specified geometric shape in advance of mandrel insertion.

17. The method defined in claim 16, which further includes the step of spraying a lubricant onto bearing surfaces of the mandrel that slidingly engage the die elements.

* * * * *